166-66 SR
3/4/80 XR 4,191,250

United States Patent [19]

Messenger

[11] 4,191,250

[45] Mar. 4, 1980

[54] TECHNIQUE FOR CEMENTING CASING IN AN OFFSHORE WELL TO SEAFLOOR

[75] Inventor: Joseph U. Messenger, Dallas, Tex.

[73] Assignee: Mobil Oil Corporation, New York, N.Y.

[21] Appl. No.: 934,927

[22] Filed: Aug. 18, 1978

[51] Int. Cl.[2] ..... E21B 43/00; E21B 49/00

[52] U.S. Cl. ..... 166/253; 166/66; 166/336

[58] Field of Search ..... 166/253, 65 R, 66, 336, 166/362, 285; 73/756, 151

[56] References Cited

U.S. PATENT DOCUMENTS

| | | | |
|---|---|---|---|
| 2,050,128 | 8/1936 | Schlumberger | 166/253 |
| 2,171,840 | 9/1939 | Armentrout et al. | 166/253 |
| 2,217,708 | 10/1940 | Scardmucci | 166/253 |
| 2,220,205 | 11/1940 | Buckley | 166/253 |
| 2,453,456 | 11/1948 | Piety | 250/260 |
| 2,524,933 | 10/1950 | Silverman | 73/152 |
| 2,669,877 | 2/1954 | Dunlap et al. | 73/151 X |
| 3,304,776 | 2/1967 | Bennett et al. | 73/151 |
| 3,489,219 | 1/1970 | Higgins | 166/253 |
| 3,990,304 | 11/1976 | Roesner | 73/151 |
| 4,010,642 | 3/1977 | McArthur | 73/151 |

*Primary Examiner*—Stephen J. Novosad
*Attorney, Agent, or Firm*—C. A. Huggett; Henry L. Ehrlich

[57] ABSTRACT

This specification discloses a method and system for cementing a casing string with returns to the seafloor in an offshore wellbore. The hydrostatic pressure at a preselected point within the annulus formed intermediate the casing string and the wellbore wall is monitored during a cementing operation to determine when cement returns in the annulus reach the seafloor and thereafter the cementing operation is terminated.

10 Claims, 4 Drawing Figures

FIG. 1
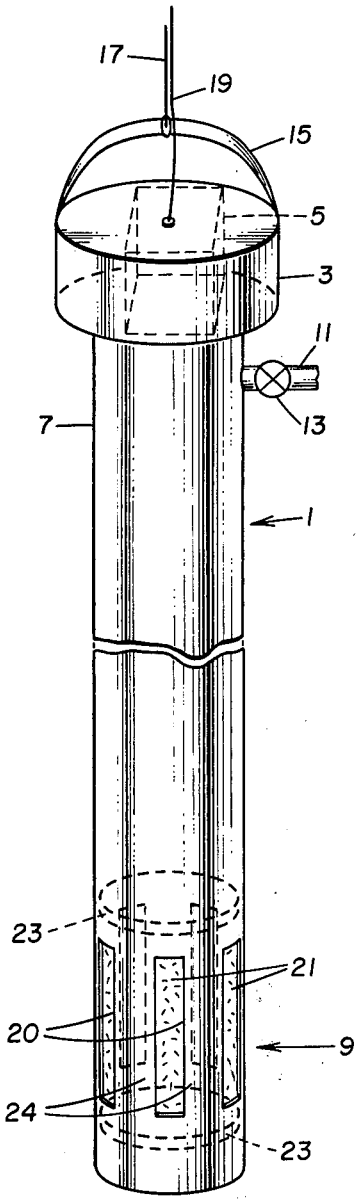
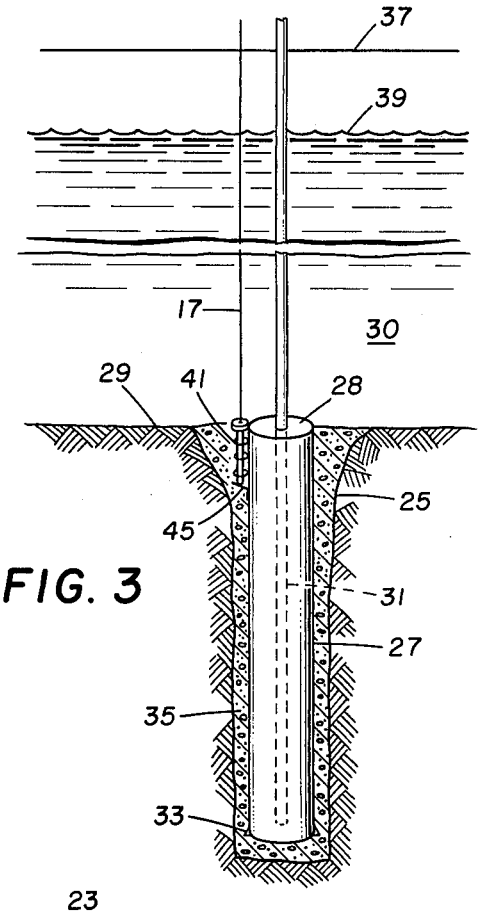
FIG. 3
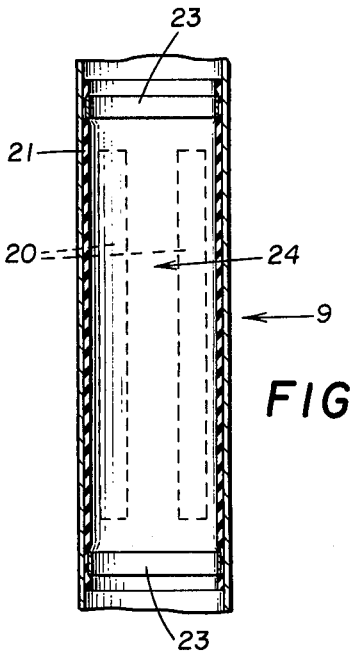
FIG. 1A

TECHNIQUE FOR CEMENTING CASING IN AN OFFSHORE WELL TO SEAFLOOR

BACKGROUND OF THE INVENTION

This invention is directed to a method of cementing a casing string in an offshore wellbore to the wall of the wellbore from the bottom of the casing string to the seafloor.

In the drilling of a wellbore under a water body, such as an offshore wellbore under an ocean or sea, it is usually desirable to cement the first two strings of casing in the wellbore from the bottom of the casing string to the seafloor. These initial strings of casing may be referred to as "shallow" or "surface" casing strings and usually extend from the seafloor into the wellbore for several hundred to several thousand feet.

In the normal course of drilling an offshore wellbore, the initial portion of the wellbore is large and the walls thereof are irregular. In the cementing of a casing string in this initial portion of the wellbore it is desirable to cement the casing string from the bottom or shoe thereof to the seafloor. Because of the irregular walls of the wellbore, it is difficult or impossible to accurately determine the volume of the annular space or annulus formed intermediate the casing string and the wellbore wall. Therefore, in carrying out a cementing operation to cement the casing string in the wellbore, the volume of the annulus is often estimated and an excess volume of cement slurry is used to provide for filling the annulus from the casing shoe to the seafloor. The results of this approach are usually that either too little cement slurry is used and the annulus is not filled to the seafloor or too much cement slurry is used and the excess slurry flows out over the seafloor and is wasted.

The problem of cementing a casing string in an offshore wellbore and providing for the cement slurry to surround the casing string from the bottom of the casing string to the seafloor has been recognized and various techniques have been suggested for detecting when the returns of the cement slurry flowing up the annulus about a casing string reach the seafloor. One technique is to use divers who descend to the seafloor and watch for the cement returns during a cementing operation. This is difficult, dangerous and expensive and the results thereof are often unsatisfactory because of the difficulties in distinguishing the cement returns from the mud returns which flow from the annulus about the casing string. Television cameras have also been described as being positioned near the seafloor in the vicinity of a wellbore during a cementing operation to enable the observation of the cement returns at the seafloor but the same difficulties in recognizing the cement returns are encountered as there experienced by divers.

In U.S. Pat. No. 3,489,219 there is described a method of determining the level of a liquid hardenable material in the annular space between a borehole and a casing string whereby a detector is placed in the borehole and the liquid hardenable material is provided with a detectable material such as radioactive material and the detectable material is then detected by the detecting device. At least one liquid hardenable material detecting means is positioned within the borehole before the injection of the liquid hardenable material into the annular space is commenced and when the liquid hardenable material reaches the level of the liquid hardenable material detecting means a signal is transmitted to the surface or any accessible location which indicates that the liquid hardenable material has reached the vicinity of the detectors. Detecting means which may be employed include gamma detectors, x-ray detectors, G-M tube or ion chamber, a glass electrode or a hydrogen electrode, temperature-sensitive devices, detecting means which utilize any part of the electromagnetics spectrum, a capacitor, an electrical resistance or conductance, a detector sensitive to changes in the magnetic field, and electrodes.

In U.S. Pat. No. 2,524,933 there is described a method and apparatus for determining in a well the position of an interface between two fluids of dissimilar character. There is introduced into a well an interface detector that will distinguish physically or chemically between two immiscible fluids in the well. The detector is located in the region of the interface and alternately submerged in each of the two fluids. By this means a positive intermittent signal is transmitted to the surface which accurately indicates the position of the interface in the well. It is noted in this patent that means which had been suggested for detecting in a well the position of a static interface between two dissimilar fluids include electrical-conductivity cell, density meter, and means which employ the difference in the light-, sound-, and heat-transmitting characteristics of the fluids in a well.

In U.S. Pat. No. 2,171,840 an electrode unit is employed to determine the position of cement slurry in a wellbore. In U.S. Pat. No. 2,220,205 a method of locating cement in boreholes is disclosed wherein there is added to the cement a radioactive material and a gamma-ray detector is lowered in the well to determine the position of the cement containing radioactive material. In U.S. Pat. No. 2,453,456 a string of Geiger counters sensitive to gamma rays is suspended in a well and used for measuring the flow of fluid in a borehole. In U.S. Pat. No. 2,217,708 there is described a technique wherein an exothermic substance is placed within casing ahead of cement in a cementing operation and a thermometric means is used to locate the crest of the fluid cement by observing the marked temperature manifestations at only one point. In U.S. Pat. No. 2,050,128 there is described a technique for locating the top of cement behind well casing by running a temperature survey of the well.

SUMMARY OF THE INVENTION

This invention is directed to a method of cementing a casing string in a wellbore drilled beneath a seafloor to the wellbore wall from the casing shoe to the seafloor. A cement slurry is injected down the casing string and into the annulus formed about the casing string while concomitantly the hydrostatic pressure in the annulus is sensed at a preselected point spaced below the seafloor. A pressure signal related to the hydrostatic pressure of the cement slurry at the preselected point in the annulus is transmitted through a column of incompressible liquid contained within a closed rigid conduit to a pressure transducer which generates a corresponding electrical signal which is transmitted to a means for indicating when the slurry in the annulus rises to the seafloor. The injection of the cement slurry down the casing string is terminated when the cement slurry reaches the seafloor and the cement slurry is maintained in the annulus and allowed to set and bond the casing string to the wellbore wall.

BRIEF DESCRIPTION OF THE DRAWINGS

FIG. 1 is an elevation drawing illustrating the apparatus for indicating the level of a cement slurry in an offshore wellbore annulus;

FIG. 1A is a cut-away drawing illustrating a means for sensing hydrostatic pressure and transmitting a pressure signal relating thereto;

FIG. 3 is a drawing further illustrating the use of the apparatus of this invention in an offshore wellbore environment.

DESCRIPTION OF THE PREFERRED EMBODIMENTS

Figure 2:
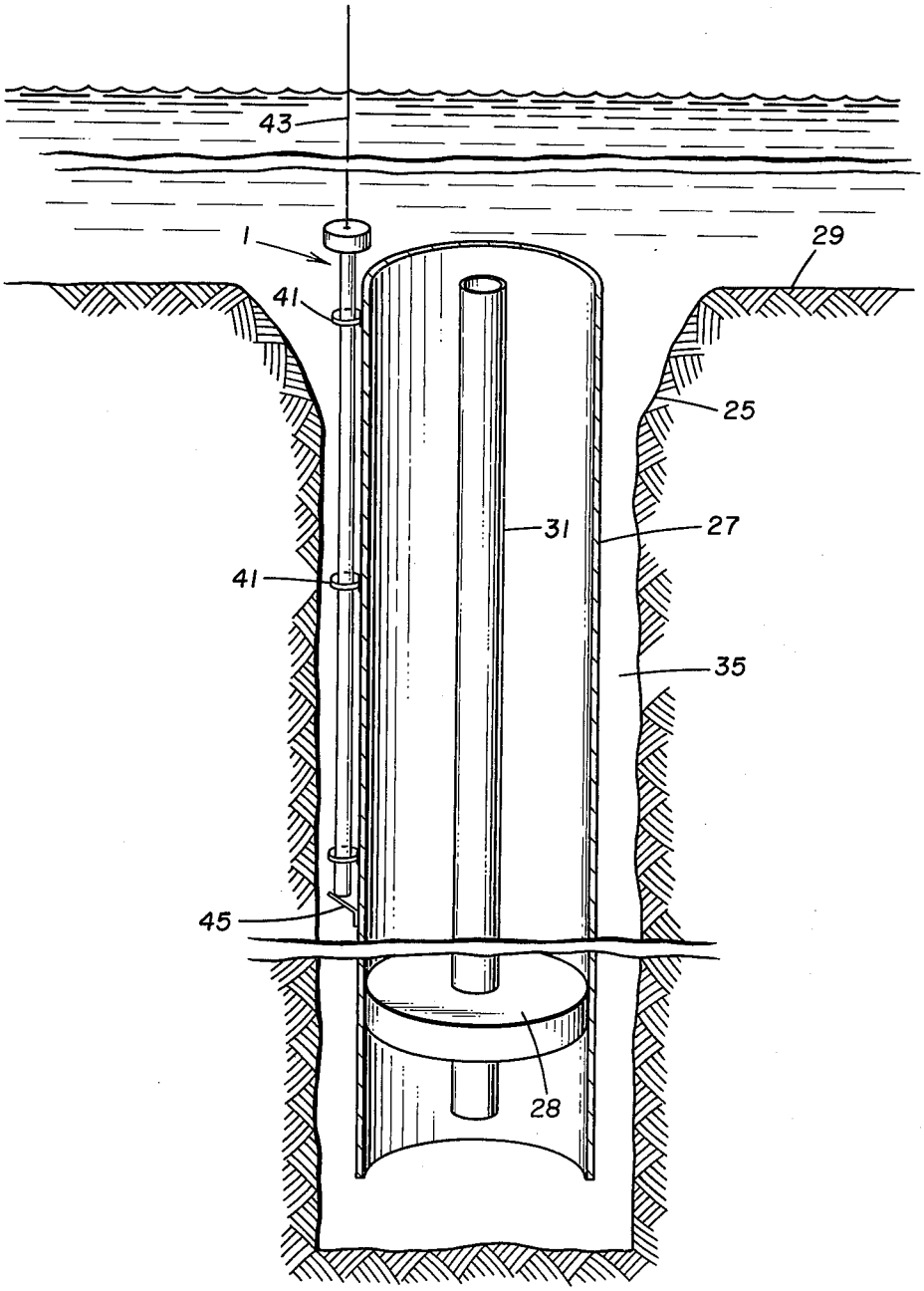
FIG. 2 is a drawing illustrating the apparatus of this invention in an offshore wellbore environment.

This invention relates to drilling a wellbore beneath a water body and to cementing shallow or surface casing strings therein from the bottom of the casing string or casing shoe to the bottom of the water body. This invention is applicable to any wellbore drilled beneath a water body, such as a lake, gulf, or sea. For simplicity of description, the wellbore will be referred to as an "offshore wellbore", the water body as a "sea", the bottom of the water body as a "seafloor", and the bottom of the casing string as a "casing shoe".

In accordance with this invention, there is provided a method and system for cementing shallow or surface casing strings in the drilling of an offshore wellbore. The casing string is positioned in the wellbore and a cement slurry is pumped down the wellbore, and usually down a drill string positioned within the casing string, and around the casing shoe and into the annulus formed about the casing string. The hydrostatic pressure in the annulus is sensed at a preselected point below the seafloor and a corresponding pressure signal is generated and transmitted through an incompressible liquid contained in a closed rigid conduit or tube to a means for generating an electrical signal in response to an applied pressure, such as a pressure transducer, that is located within the sea above the seafloor. The pressure transducer generates an electrical signal which is related to the hydrostatic pressure in the annulus at the preselected point and the electrical signal is transmitted via electrical conductors to an indicating means or alarm means which may be located above the sea or within the sea as desired. The indicating means or alarm means may be calibrated as desired to indicate the hydrostatic pressure at the preselected point or to indicate, for example, the height of the cement slurry in the annulus. Upon the cement slurry in the annulus reaching the seafloor the cementing operation is terminated and the cement slurry is maintained in the annulus and allowed to set and bond the casing string to the wellbore wall from the casing shoe to the seafloor.

The system of this invention is better understood by reference to FIG. 1. A system 1 is there shown for sensing a hydrostatic pressure at a preselected point within an annulus formed about a casing string and usually intermediate a casing string and a wellbore wall. This system 1 is comprised of a transducer housing 3 which has mounted therein a pressure transducer 5. The transducer housing 3 is attached to a closed rigid conduit or tube 7 which has at a lower end thereof a pressure sensitive means 9. The tube 7 is adapted for filling with an incompressible liquid and such an adaptation may take the form of an inlet means 11 and valve 13. A port means (not shown) may be provided for evacuating air from the tube 7 during the filling thereof to facilitate the complete filling of the tube 7 with an incompressible liquid. The system 1 contains an attaching means 15, illustrated here as a bail, such that a cable 17 may be attached thereto for retrieving the system 1 from a wellbore annulus and recovering the system at the surface of the water body or sea. The cable 17 may further contain electrical conductors 19 which connect with the pressure transducer 5 and lead to an indicating means (not shown) that is accessible for observing.

The transducer 5 for converting pressure signals into electrical signals may be a pressure transducer, a differential pressure transducer, or a pressure switch. An example of a suitable pressure transducer is a Model LX 1603 D pressure transducer available from National Semiconductor, 2900 Semiconductor Drive, Santa Clara, Calif. Other off-the-shelf pressure transducers, differential pressure transducers, and pressure switches may be used in the present system. A pressure switch is essentially a pressure transducer or differential pressure transducer adapted to operate a switch at a preselected pressure or differential pressure which switch may then be adapted to operate an indicating means or alarm.

With reference again to FIG. 1, the transducer housing 3 is mechanically attached, for example, by threads or by welding to the closed tube 7. The transducer 5 is mounted in the transducer housing 3 to have pressure communication with the inside of the tube 7. The pressure communication may be provided, for example, by a diaphragm or bellows (not shown) mounted in the lower part of the transducer housing 3 to provide for pressure communication between the inside of the tube 7 and the transducer 5. In the case where the transducer 5 is selected to be a differential pressure transducer, pressure communication from above the transducer 5 may likewise be provided by installing, for example, a diaphragm or bellows (not shown) in the upper part of the transducer housing 3 such that pressure communication from the environment immediately above the transducer 5 may be communicated to the transducer 5. An electrical conductor or conductors 19 lead from the transducer 5 through the transducer housing 3 where they may be adapted for connecting with an appropriate indicating means or alarm (not shown).

The tube 7 is of appropriate length and size for use in a wellbore annulus. A suitable and practical length of the tube 7 may be, for example, at least about 30 feet and preferably about 40 feet and a suitable and practical size of the tube may be, for example, about 2 inches in diameter. Such a tube may be inserted into an annulus and extend therein a sufficient distance to sense the hydrostatic pressure in the annulus and give a clear indication of the rise of the cement slurry in the annulus above the pressure sensitive means 9 while at the same time allow the transducer housing 3 and the transducer 5 to be maintained in the sea above the seafloor such that it does not come into contact with the cement slurry. This will better enable the system 1 to be withdrawn from the annulus of a wellbore where it is used.

The lower portion of the tube 7 is adapted with a means 9 for sensing hydrostatic pressure and transmitting a corresponding pressure signal through a column of incompressible liquid contained in the tube 7 to the pressure transducer 5. The means 9 for sensing hydrostatic pressure and transmitting a corresponding pressure signal is illustrated both in FIGS. 1 and 1A. Essentially this means 9 is comprised of openings such as slots 20 extending through the tube 7 and positioned circumferentially therearound to form a cage 24 having a diaphragm 21 formed of a flexible material such as rubber affixed within the tube by upper and lower holding means 23. The holding means 23 may be, for example, spring brackets for holding the diaphragm 21 against the inside of the tube 7 in a fluid-tight connection therewith. The size and number of the slots 20 provided in the tube must be sufficient to provide for sensing hydrostatic pressure imposed thereon at the location of the means 9 and transmitting this hydrostatic pressure as a pressure signal through the incompressible liquid provided within the tube 7. Desirably, the slots will be about one foot in height and about one-half inch in width. Normally, about five slots positioned 72° one from the other about the tube will be sufficient for the purposes desired. The slotted tube forms a cage 24 for protecting the flexible diaphragm 21 positioned within the tube 7 at the level of the slots 20.

Turning now to FIGS. 2 and 3, there is shown an offshore wellbore 25 having a casing string 27 positioned therein. A drill string 31 is positioned within the casing string 27 and extends to the lower portion thereof to facilitate the circulating of a cement slurry around the casing shoe 33, as indicated in FIG. 3, and into the annulus 35 formed intermediate the casing string 27 and the wall of the wellbore 25. This technique is also applicable for cementing a second string of casing (not shown) to the wellbore wall wherein the second string of casing extends within and below the casing string 27 and wherein the cement slurry is positioned in the annulus formed about the second string from the bottom thereof to the seafloor and allowed to there set and bond the second string to the casing string 27 and thus to the wall of the wellbore 25 and to the wall of the wellbore 25 that would be exposed to the annulus below the bottom of the casing string 27. In FIG. 3, a line labeled 37 represents the level of a kelly bushing on the floor of a drilling rig (not shown). The sea surface 39 is there shown as is the seafloor 29 and the sea 30.

In accordance with a further embodiment of this invention, the means 1 for measuring a cement slurry head is positioned along the casing string 27 and held in position by support rings 41. A cable 17 which includes a stress cable and may further include the electrical conductors 19 attaches to the means 1 and extends to the drilling rig (not shown). A protector 45 is attached to the casing string 27 in a position to protect the lower portion of the means 1 for measuring a cement head and for protecting the support rings 41. This protector 45 may be a metal shield which is welded onto the casing string 27 at a position immediately below the lower end of the means 1. The casing string 27 is positioned within the wellbore 25 with the means 1 for measuring a cement slurry head attached thereto such that the transducer housing 3 remains above the seafloor 29 and within the sea 30 while the means 9 for sensing hydrostatic pressure and transmitting a corresponding pressure signal is positioned at a preselected point within the annulus 35. A drill string 31 is positioned in the casing string 27 to facilitate the cementing of the casing string 27 to the wall of the wellbore 25. A suitable running tool 28 or other means such as a duplex shoe or packer is normally used in conjunction with the drill string 31 and casing string 27 to facilitate the injection of cement into the annulus 35.

A cement slurry (not shown) is injected down the drill string 31 and around the casing shoe 33 and into the annulus 35 while concomitantly the hydrostatic pressure in the annulus is monitored at a preselected point by the means 1 for measuring a cement slurry head. As the cement slurry in the annulus 35 rises above the means 9 for sensing the hydrostatic pressure in the annulus a pressure signal is generated related to the hydrostatic pressure of the cement slurry column in the annulus above the means 9 for sensing hydrostatic pressure. This pressure signal is transmitted through an incompressible liquid contained in a tube to a transducer 9 which in turn generates an electrical signal which is transmitted via electrical conductors to an appropriate display or alarm (not shown). The means 1 for measuring a cement head produces information which indicates when the cement slurry in the annulus 35 reaches the seafloor. The injection of cement slurry down the drill string 31 is then terminated or if desired a preselected amount of shoe cement slurry may then be injected down the drill string and positioned about the lower portion of the casing string 27. The drill string is then cleared of cement slurry, and the cement slurry in the annulus 35 is there maintained and allowed to set and bond the casing string 27 to the wall of the wellbore 25 from the casing shoe 33 to the seafloor 29. The means 1 for measuring a cement slurry head is withdrawn from the annulus prior to the setting of the cement slurry therein. In carrying out this technique, it may be desirable as it sometimes is in carrying out other cementing operations to first use a lead cement slurry and follow this with a shoe cement slurry.

The term "head" when used with regard to the cement slurry head may be considered the pressure expressed as a height of liquid cement slurry necessary to develop that pressure at the preselected point where the pressure is measured in the annulus. This pressure-height relationship varies with the density of the material which forms hydrostatic pressure at the preselected point. By knowing the density of the cement slurry in the annulus and the distance of the preselected point below the seafloor the height of the cement slurry above the preselected point may readily be known.

Off-the-shelf apparatus may be used to determine from the pressure signal generated at the preselected point when the cement slurry in the annulus reaches the seafloor. For example, the pressure transducer which generates a corresponding electrical signal in response to the pressure signal may connect via electrical conductors to a recording means such as a chart recorder located at the rig floor. As an alternative the electrical conductors may connect with a selected alarm circuit or means which will generate an alarm when the cement slurry in the annulus reaches the seafloor. The alarm means could, for example, be a light which is connected via appropriate switching and circuitry means such that the light will come on when the cement slurry reaches the seafloor. Likewise, a sound alarm, such as a horn, could be used if desired. Further, if desired, the alarm and particularly a light could be located at the seafloor. This would require, however, that the alarm or light at seafloor be there monitored.

What is claimed is:

1. In the drilling of a wellbore beneath a seafloor the method of cementing a casing string to the wellbore wall from the casing shoe to the seafloor, comprising:

(a) injecting a cement slurry down the casing string and into the annulus formed about the casing string;

(b) concomitantly sensing the hydrostatic pressure in the annulus at a preselected point spaced below the seafloor;

(c) transmitting a pressure signal related to the hydrostatic pressure of the cement slurry at the preselected point in the annulus through a column of incompressible liquid contained within a closed rigid conduit to a pressure transducer which generates a corresponding electrical signal;

(d) transmitting said electrical signal to a means for indicating when the cement slurry in the annulus rises to the seafloor;

(e) terminating the injection of cement slurry down said casing string when said cement slurry reaches the seafloor; and (f) maintaining said cement slurry in said annulus to allow said slurry to set and bond said casing string to said wellbore wall.

2. The method of claim 1 wherein a drilling string is positioned within said casing string and wherein said cement slurry is injected down said drilling string and into said annulus.

3. In the drilling of a wellbore beneath a seafloor the method of cementing a casing string to the wellbore wall from the bottom of the casing string to the seafloor, comprising:

(a) positioning said casing string in said wellbore to extend therein from said seafloor, said casing string having positioned along an upper portion thereof and within the annulus formed thereabout a means for measuring a cement slurry head in said annulus intermediate a preselected point therein and said seafloor;

(b) positioning a drill string in said casing string to carry out a cementing operation;

(c) injecting cement slurry down said drill string and into said annulus and concomitantly monitoring the head of said cement slurry in said annulus above said preselected point to determine when the upper level of said cement slurry in said annulus reaches said seafloor;

(d) terminating the injection of said cement slurry down said drill string about when said slurry reaches the seafloor; and (e) maintaining said cement slurry in said annulus to allow said cement slurry to set and bond said casing string to said wellbore wall from the lower end of said casing string to said seafloor.

4. The method of claim 3 wherein said means for measuring a cement slurry head in said annulus is comprised of a means for generating an electrical signal in response to a pressure signal, a closed tube filled with an incompressible liquid having pressure communication at an upper portion thereof with said means for generating an electrical signal, said tube having at a lower portion thereof a means for sensing hydrostatic pressure and generating a pressure signal in response thereto and transmitting said pressure signal through said incompressible liquid filling said tube.

5. Apparatus for indicating the level of a cement slurry in an offshore wellbore annulus, comprising:

(a) a rigid closed conduit filled with an incompressible liquid;

(b) a means for sensing hydrostatic pressure and transmitting a pressure signal relating thereto, connecting with said rigid closed conduit near one end thereof;

(c) a housing connecting with said rigid closed conduit at the other end thereof;

(d) a means for generating an electrical signal in response to a pressure signal mounted in said housing and having pressure communication with the interior of said rigid closed conduit; and (e) an electrical conductor connecting with said means for transmitting an electrical signal in response to a pressure signal, said conductor passing through said housing for connecting with an indicating means.

6. The apparatus of claim 5 wherein said means for sensing hydrostatic pressure is comprised of a cage formed in said rigid closed conduit by providing openings through said conduit and providing a flexible diaphragm within said conduit adjacent said openings, said diaphragm being maintained to provide a fluidtight seal between the interior and exterior of said conduit.

7. Apparatus for indicating the level of a cement slurry in an offshore wellbore annulus, comprising:

(a) a rigid closed conduit adapted to be filled with an incompressible liquid, (b) a means for sensing hydrostatic pressure and transmitting a pressure signal relating thereto, connecting with said rigid closed conduit near one end thereof, said means for sensing hydrostatic pressure being comprised of a cage formed in said rigid closed conduit by providing openings through said conduit and providing a flexible diaphragm within said conduit adjacent said openings, said diaphragm being maintained to provide a fluidtight seal between the interior and exterior of said conduit, (c) a housing connecting with said rigid closed conduit at the other end thereof, (d) a pressure transducer for generating an electrical signal in response to a pressure signal mounted in said housing and having pressure communication with the interior of said rigid closed conduit, said pressure transducer being spaced laterally at least about 30 feet from said means for sensing hydrostatic pressure, and (e) an electrical conductor connecting with said means for transmitting an electrical signal in response to a pressure signal, said conductor passing through said housing for connecting with an indicating means.

8. The apparatus of claim 7 further comprising a means for filling said closed conduit with an incompressible liquid.

9. The apparatus of claim 8 further comprising a means for supporting said apparatus for indicating the level of a cement slurry in an offshore wellbore attached thereto and adapted for connecting with a cable to support said apparatus.

10. The apparatus of claim 9 wherein said pressure transducer is a differential pressure transducer.

* * * * *